US009024774B2

(12) United States Patent
Li et al.

(10) Patent No.: US 9,024,774 B2
(45) Date of Patent: May 5, 2015

(54) EMERGENCY LIGHTING AND EVACUATION GUIDANCE SYSTEM POWERED BY MEDLEY ENERGY SOURCES

(71) Applicants: Shaobin Li, Shenzhen (CN); Wenguang Luo, Shenzhen (CN); Wenhui Hua, Shenzhen (CN)

(72) Inventors: Shaobin Li, Shenzhen (CN); Wenguang Luo, Shenzhen (CN); Wenhui Hua, Shenzhen (CN)

(73) Assignee: Shenzhen Guangan Fire-Fighting & Decoration Engineering Co., Ltd., Shenzhen, Guangdong (CN)

( * ) Notice: Subject to any disclaimer, the term of this patent is extended or adjusted under 35 U.S.C. 154(b) by 162 days.

(21) Appl. No.: 13/894,372

(22) Filed: May 14, 2013

(65) Prior Publication Data

US 2014/0184420 A1 Jul. 3, 2014

(30) Foreign Application Priority Data

Dec. 31, 2012 (CN) ..... 2012 1 0592268

(51) Int. Cl.

| | |
|---|---|
| ***G08B 23/00*** | (2006.01) |
| ***F21S 9/02*** | (2006.01) |
| ***A62B 3/00*** | (2006.01) |
| ***G08B 7/06*** | (2006.01) |

(52) U.S. Cl.

CPC ..... *F21S 9/022* (2013.01); *Y10T 29/49117* (2015.01); *A62B 3/00* (2013.01); *G08B 7/066* (2013.01)

(58) Field of Classification Search

CPC ..... G08B 7/066; G08B 23/00; G08B 5/00; G09F 2019/225; Y02B 10/10; Y02B 10/20; Y02B 10/22; Y02B 10/30; F21S 9/022; A62B 3/00; Y10T 29/49117

USPC ..... 340/506, 540, 577, 588, 628, 326, 340/691.1, 691.6, 693.2, 691.8; 362/84, 362/570, 812; 40/542, 544

See application file for complete search history.

(56) References Cited

U.S. PATENT DOCUMENTS

| | | | | |
|---|---|---|---|---|
| 5,775,016 | A * | 7/1998 | Chien | 40/544 |
| 5,815,068 | A * | 9/1998 | Vadseth | 340/332 |
| 6,313,549 | B1 * | 11/2001 | Moisan et al. | 307/66 |
| 7,800,511 | B1 * | 9/2010 | Hutchison et al. | 340/691.1 |
| 2002/0057204 | A1 * | 5/2002 | Bligh | 340/691.1 |
| 2010/0019901 | A1 * | 1/2010 | Tsai | 340/540 |
| 2010/0309004 | A1 * | 12/2010 | Grundler et al. | 340/588 |
| 2010/0321930 | A1 * | 12/2010 | Watanabe et al. | 362/184 |

* cited by examiner

*Primary Examiner* — Hung T Nguyen

(74) *Attorney, Agent, or Firm* — Raymond Y. Chan; David and Raymond Patent Firm

(57) ABSTRACT

An emergency lighting and evacuation guidance system includes an emergency lighting and evacuation guidance arrangement which is electrically connected to a commercial electricity supply, and a complementary green power assembly which is electrically connected to the emergency lighting and evacuation guidance arrangement. When the commercial electric supply is cut off during an emergency, the power generated by the complementary green power assembly is supplied to the emergency lighting and evacuation guidance arrangement, whereby the emergency lighting and evacuation guidance arrangement guides people to evacuate and escape during the emergency.

4 Claims, 5 Drawing Sheets

EMERGENCY LIGHTING AND EVACUATION GUIDANCE SYSTEM POWERED BY MEDLEY ENERGY SOURCES

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

1. Field of Invention

The present invention relates to an emergency lighting and evacuation guidance system of a building, and more particularly to an emergency lighting and evacuation guidance system which is powered by medley energy sources including wind power, solar power, and electric power arranged for providing a complementary power supply, so that it is beneficial for protecting the environment and providing a convenience for guiding the people in a emergency to evacuate and escape in an orderly manner.

2. Description of Related Arts

It is known that the electric power, which is the lifeline of the national economy, is an indispensable part in our lives. Currently, the electric power in the industry and daily lives mainly relies on the power generated by coals, nucleic fuels, and other resources. However, coals and nucleic fuels are non-renewable energy resources. With the development of the global economy and the increase of the human population, there is increasing need for electric power. However, the energy resources accessible for exploitation are reducing. The contradiction between the increasing need of the electric power and the shortage of energy generation resources has become an urgent issue. With the development of urbanization, people need more electric power to develop the industry, decorate the city and achieve the domestic electrification, so that the requirement for electric power is continuously growing. In addition, the power generation process of coals will discharge a large amount of carbon dioxide directly into the atmosphere and the environment will be polluted. Thus, the use of natural energy resources such as wind power, solar power, and potential energy to solve the problem of the increasing need of electric power and the protection of environment has become a main issue.

Currently, since the atmosphere and the environment have become deteriorated, natural disasters frequently take place. In addition, the overuse and misuse of electricity, coal gas, and natural gas also result in the occurrence of fire disasters. When a fire disaster takes place, the electric supply will be cut off. Therefore, the exits and other necessary positions in the buildings are provided with emergency evacuation guide and emergency lighting, so as to provide emergency evacuation guide and lighting for people to evacuate and escape when the electric supply is cut off. However, the conventional emergency evacuation guidance arrangement and emergency lighting is powered by coal-based storage battery, which consumes a large amount of coal resources. Thus, it is not beneficial for environment protection, energy-saving and emission-reduction.

SUMMARY OF THE PRESENT INVENTION

The main object of the present invention is to provide an emergency lighting and evacuation guidance system powered by medley complementary energy sources such as wind power, solar power, commercial electric power so as to provide an emergency evacuation guide and emergency lighting for the evacuating and escaping people, so that the people can orderly evacuate and escape during the emergency.

Another object of the present invention is to provide an emergency lighting and evacuation guidance system powered by medley complementary energy sources, wherein the complementary energy sources can be green power such as the wind power and the solar power, so that it is environmental friendly and energy-saving.

Another object of the present invention is to provide an emergency lighting and evacuation guidance system powered by medley complementary energy sources, wherein when the emergency lighting and evacuation guidance system is normally powered by the AV electric power, during an emergency, the AV electricity supply may be cut off, the emergency lighting and evacuation guidance system can be automatically shifted to an emergency state in which complementary energy sources are activated to provide the energy supply to the emergency lighting and evacuation guidance system.

Another object of the present invention is to provide an emergency lighting and evacuation guidance system powered by medley complementary energy sources, wherein the power generated by the complementary energy sources such as wind power and solar power can be previously stored in a storage battery, when the commercial electricity power is cut off, the power generated by the complementary energy sources can be immediately supplied to the emergency lighting and evacuation guidance system.

Another object of the present invention is to provide an emergency lighting and evacuation guidance system powered by medley complementary energy sources, wherein the structure is simple and the operation of the system will win time so as to save lives during an emergency.

Additional advantages and features of the invention will become apparent from the description which follows, and may be realized by means of the instrumentalities and combinations particular point out in the appended claims.

According to the present invention, the foregoing and other objects and advantages are attained by an emergency lighting and evacuation guidance system comprising an emergency lighting and evacuation guidance arrangement which is electrically connected to a commercial electricity supply, and a complementary green power assembly which is electrically connected to the emergency lighting and evacuation guidance arrangement, wherein when the commercial electric supply is cut off during an emergency, the power generated by the complementary green power assembly is supplied to the emergency lighting and evacuation guidance arrangement, whereby the emergency lighting and evacuation guidance arrangement guides people to evacuate and escape during the emergency.

The emergency lighting and evacuation guidance arrangement may comprise at least one emergency evacuation guidance arrangement which is provided in a building for providing an evacuation information during the emergency, the evacuation information is selected from a group consisting of a runner safety exit sign, a text safety exit sign, an evacuation map, an indication information of a location of the emergency, and the combinations thereof.

The emergency lighting and evacuation guidance arrangement may comprise at least one loud speaker for providing a vocal emergency information during the emergency.

The emergency lighting and evacuation guidance arrangement may comprise at least one emergency lighting arrangement, which is provided at a location selected from a group consisting of a corridor, a staircase, an evacuation passage, a safety exit of the building, and the combinations thereof, for providing a lighting during the emergency.

The emergency lighting and evacuation guidance arrangement may further comprise at least one emergency lighting arrangement, which is provided at a location selected from a group consisting of a corridor, a staircase, an evacuation passage, a safety exit of the building, and the combinations thereof, for providing a lighting during the emergency.

The emergency lighting and evacuation guidance system may further comprise a storage battery assembly, wherein the complementary green power assembly and the commercial electricity supply are both electrically connected to the storage battery assembly, wherein the emergency lighting and evacuation guidance arrangement is powered by the storage battery assembly.

The complementary green power assembly may comprise at least one photovoltaic power generation arrangement, and at least one wind electric power generation arrangement. The complementary green power assembly comprises at least one photovoltaic power generation arrangement, and at least one wind electric power generation arrangement, wherein the photovoltaic power generation arrangement and the wind electric power generation arrangement are electrically connected to the storage battery assembly, so that the power generated by the photovoltaic power generation arrangement and the wind electric power generation arrangement is stored in the storage battery assembly.

The emergency lighting and evacuation guidance system may further comprise a normally closed relay which electrically connects the storage battery assembly with the commercial electricity supply.

The emergency evacuation guidance arrangement comprises a first power-down activation switch and at least one emergency evacuation indication lighting, wherein the first power-down activation switch is electrically connected to the normally closed relay, storage battery assembly, and the emergency evacuation indication lighting, wherein when disasters or sudden emergencies take place to cut off the electricity supply, the normally closed relay is switched off, wherein the first power-down activation switch electrically connects the storage battery assembly and the emergency evacuation indication lighting in such a manner that the storage battery assembly provides an electricity supply to the emergency evacuation indication lighting.

The emergency evacuation indication lighting can be an LED lamp which is provided for displaying a safety exit sign and/or a text sign.

The emergency lighting arrangement comprises a second power-down activation switch and at least one light illuminator, wherein the second power-down activation switch is electrically connected to the normally closed relay, storage battery assembly, and the light illuminator, wherein when disasters or sudden emergencies take place to cut off the electricity supply, the normally closed relay is switched off, wherein the second power-down activation switch electrically connects the storage battery assembly and the light illuminator in such a manner that the storage battery assembly provides an electricity supply to the light illuminator.

The light illuminator can be an LED lamp.

The first and second power-down activation switches are normally open relays. The first power-down activation switch is electrically connected to the normally closed relay, storage battery assembly, and the emergency evacuation indication lighting. The second power-down activation switch is electrically connected to the normally closed relay, storage battery assembly, and the light illuminator. When disasters or sudden emergencies take place to cut off the electricity supply, the normally closed relay is switched off, the normally open relays are switched on to electrically connect the storage battery assembly with the emergency evacuation indication lighting and the light illuminator in such a manner that the storage battery assembly provides an electricity supply to the emergency evacuation indication lighting and the light illuminator.

The photovoltaic power generation arrangement comprises at least one solar power panel and a solar power controller coupled with the solar power panel and the storage battery assembly.

The solar power panel is selected from a group consisting of a crystalline silicon power panel, an amorphous silicon power panel, and a poly compound solar cell.

The storage battery assembly is selected from a group consisting of a Ni—H battery assembly, a NI—Cd battery assembly, and a Li battery assembly.

The wind electric power generation arrangement comprises a wind electric power generator and a wind electric power charger which is electrically connected to the wind electric power generator and storage battery assembly. The wind electric power generation arrangement can be provided on top of the building.

The wind electric power generator can be a horizontal axis electric power generator or a vertical axis electric power generator.

The present invention solves the problem that it is not beneficial for environment protection, energy saving and emission reduction when non-renewable energy resources such as coals are used in emergency evacuation and emergency lighting system. The emergency evacuation and emergency lighting system of the present invention is provided with a complementary electric power supply system of green power such as solar power and wind power, and commercial electricity power, so that it not only provides an evacuation and escape lighting for the evacuating and escaping people in an emergency so as to orderly guide people to evacuate and escape, but also is beneficial for environment protection, energy saving and emission reduction, thus the resources such as colas are effectively saved. The present invention is also advantageous for its simple structure and easy application.

The present invention further provides a method of assembling an emergency lighting and evacuation guidance system which comprises the following steps.

(a) Electrically connect at least one emergency lighting and evacuation guidance arrangement to a commercial electricity supply.

(b) Electrically connect at least one complementary green power assembly to the emergency lighting and evacuation guidance arrangement.

(c) Selectively supply power to the emergency lighting and evacuation guidance arrangement through the commercial electricity supply and the complementary green power assembly to activate the emergency lighting and evacuation guidance arrangement for guiding people to evacuate and escape during an emergency.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
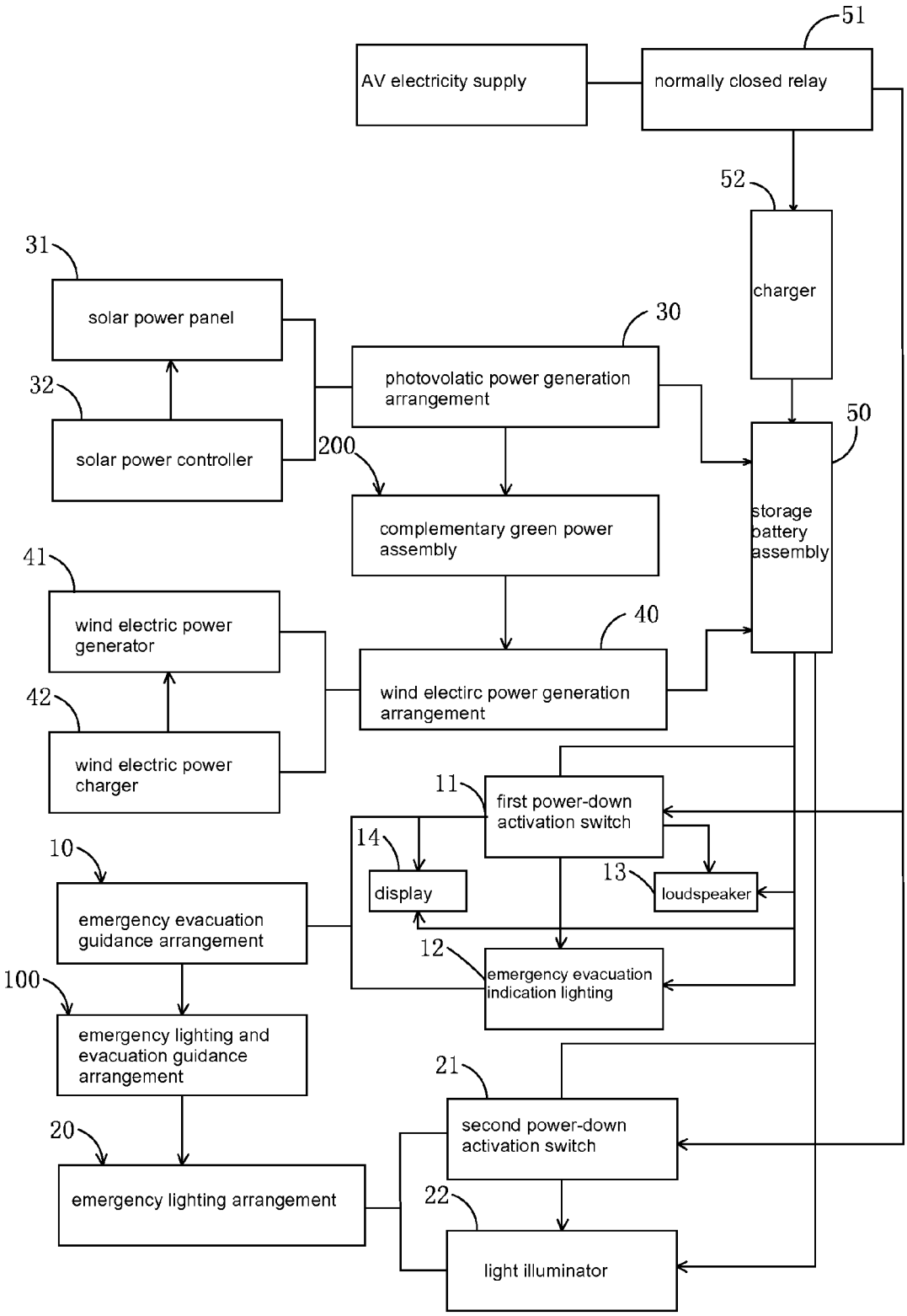
FIG. 1 is a schematic view of an emergency lighting and evacuation guidance system according to a preferred embodiment of the present invention.

Referring to FIG. 1 of the drawings, an emergency lighting and evacuation guidance system according to a preferred embodiment of the present invention is illustrated. The emergency lighting and evacuation guidance system comprises at least one emergency evacuation guidance arrangement 10, at least one emergency lighting arrangement 20, at least one photovoltaic power generation arrangement 30, at least one wind electric power generation arrangement 40, and a storage battery assembly 50.

Figure 2:
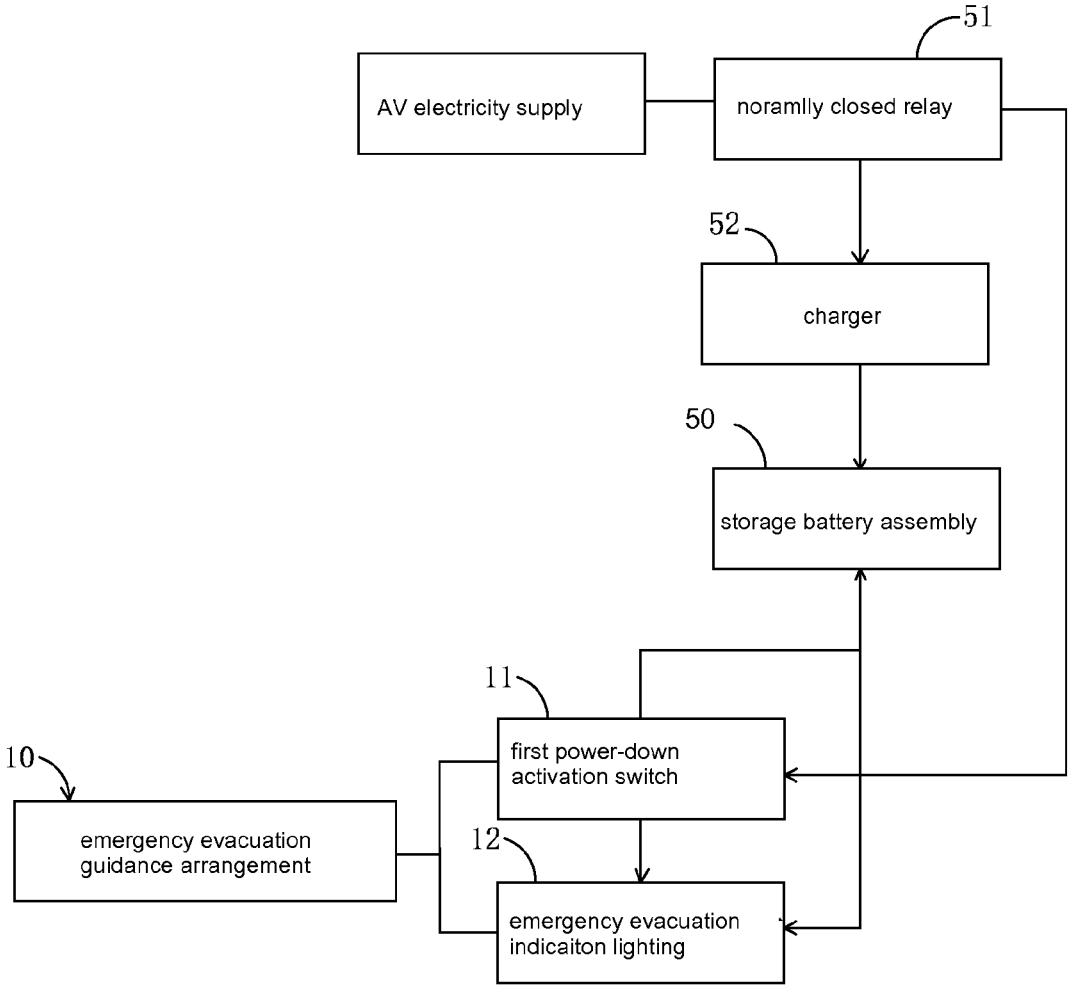
FIG. 2 is a schematic view of an evacuation guidance arrangement of the emergency lighting and evacuation guidance system according to the above preferred embodiment of the present invention.
Figure 3:
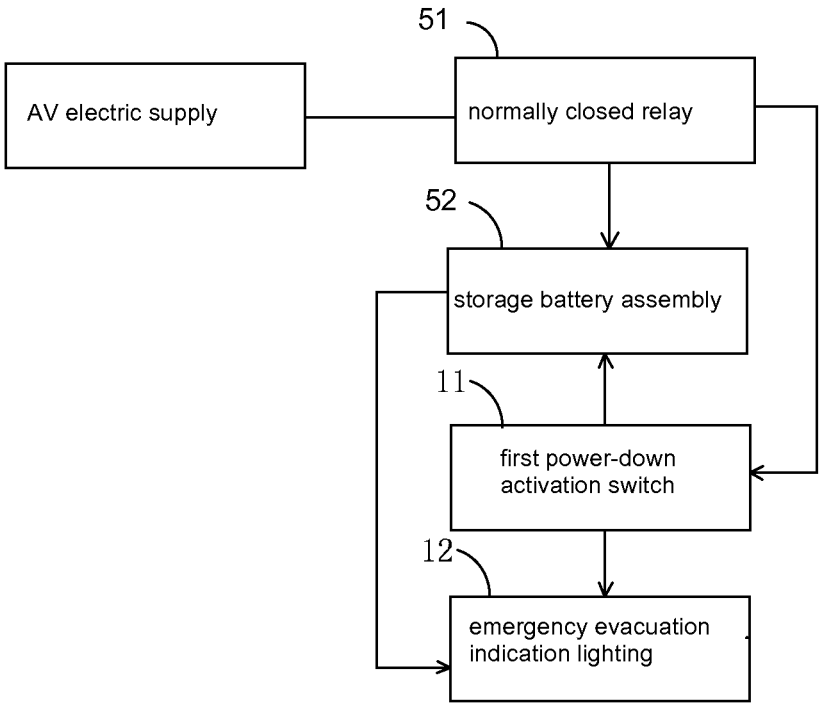
FIG. 3 is a schematic view of a first power-down activation switch of the emergency lighting and evacuation guidance system according to the above preferred embodiment of the present invention.

The one or more emergency evacuation guidance arrangement 10 is respectively provided at the safety exits of a building for providing an evacuation guide to the evacuating people in case of disasters such as fire disasters and earthquakes or sudden emergencies. Referring to FIG. 2 of the drawings, each of the emergency evacuation guidance arrangements 10 comprises a first power-down activation switch 11 and an emergency evacuation indication lighting 12. In this preferred embodiment, the emergency evacuation indication lighting can be embodied as a rectangle LED lamp. A display at a front side of the LED lamp is provided with a runner safety exit sign, and text exits signs in language of English, Chinese, or other languages. The input voltage can be 12V. Referring to FIG. 3 of the drawings, the first power-down activation switch is electrically connected to a normally closed relay 51, the storage battery assembly, and the emergency evacuation indication lighting 12. In this preferred embodiment, the first power-down activation switch 11 is a normally open relay. More specifically, in this preferred embodiment, the first power-down activation switch 11 is a normally open phase failure relay. An input terminal of the normally open relay 11 is in a parallel connection with the normally closed relay 51, and an output terminal of the normally open relay 11 is electrically connected to the storage battery 50 and the emergency evacuation indication lighting 12. When disasters such as fire disasters and earthquakes or sudden emergencies take place, the domestic electricity supply which is electrically connected to the public power system may be out of service, the normally closed contacts of the normally closed relay 51 will be cut off because of a phase failure. At the same time, the normally open contacts of the normally open relay will be switched on because of the phase failure, so that the storage battery assembly 50 is electrically connected to the emergency evacuation indication lighting 12 so as to supply power to the emergency evacuation indication lighting 12. Thus the emergency evacuation indication lighting 12 can provide an emergency evacuation guide to the people to be evacuated.

Figure 4:
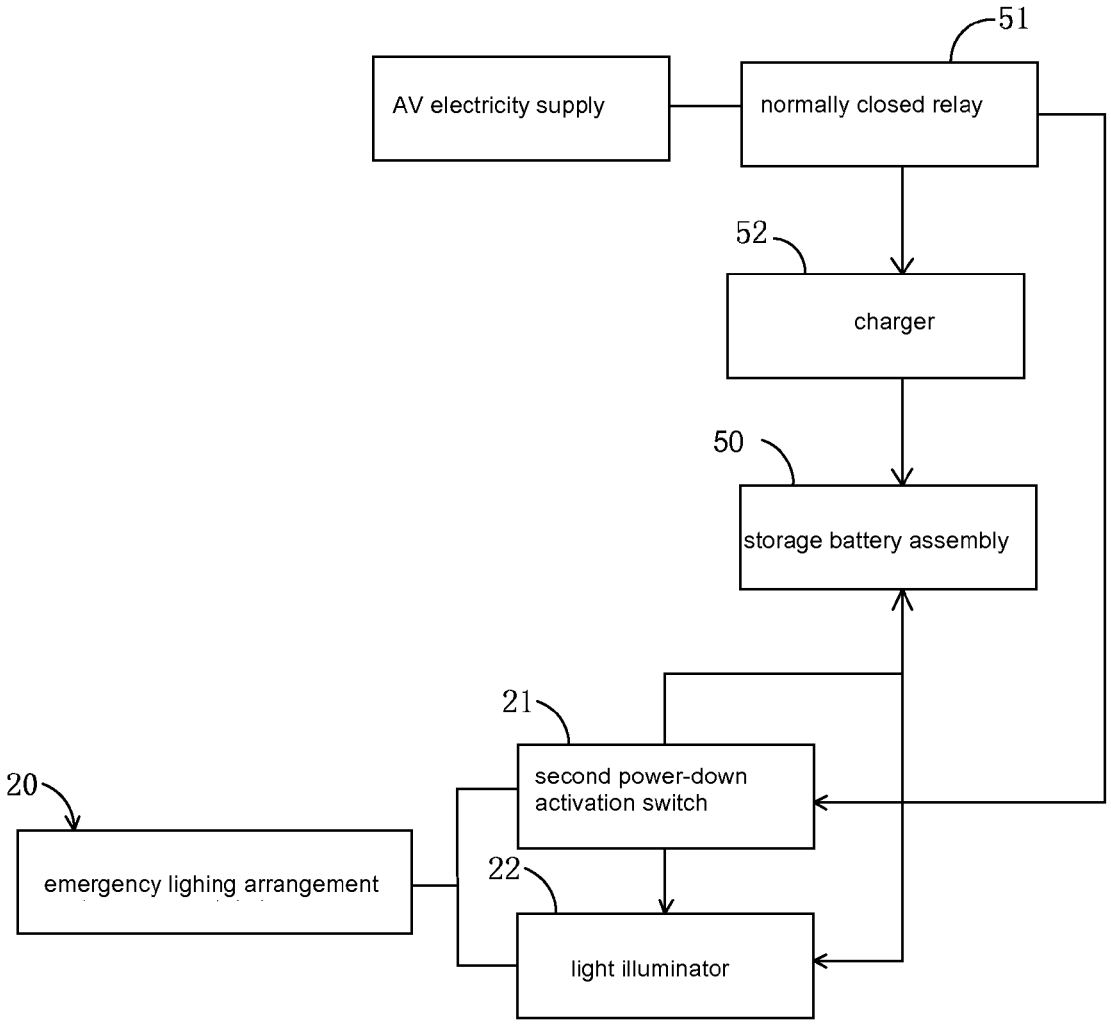
FIG. 4 is a schematic view of an emergency lighting of the emergency lighting and evacuation guidance system according to the above preferred embodiment of the present invention.
Figure 5:
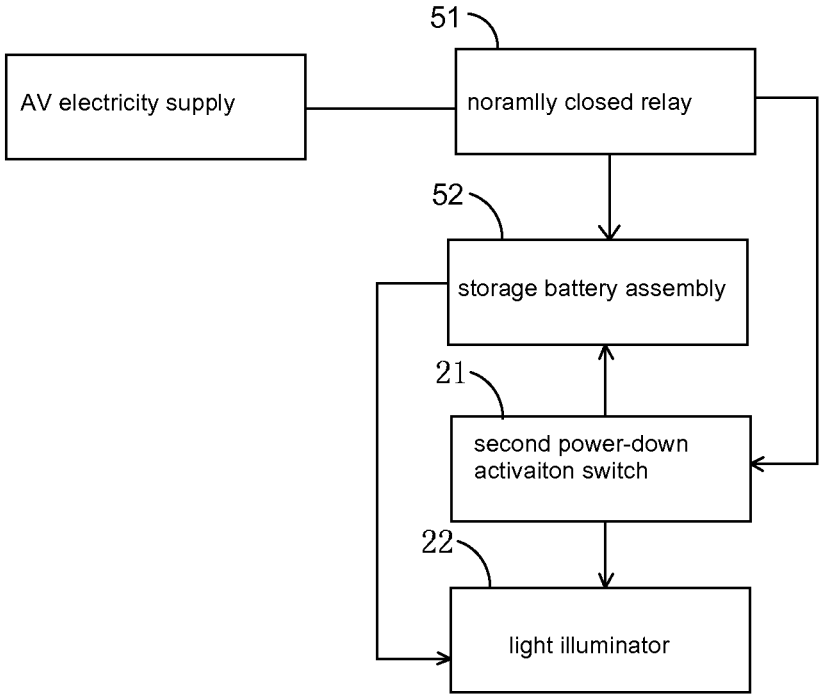
FIG. 5 is a schematic view of a second power-down activation switch of the emergency lighting and evacuation guidance system according to the above preferred embodiment of the present invention.

Referring to FIG. 4 of the drawings, the emergency lighting arrangements 20 are respectively provided at corridors, staircases, evacuation passages, and safety exits of a building so as to provide an evacuation and escape lighting for the evacuating and escaping people in case of disasters such as fire disasters and earthquakes or sudden emergencies. Referring to FIG. 4 of the drawings, each of the emergency lighting arrangements 20 comprises a second power-down activation switch 21 and at least one light illuminator 22. In this preferred embodiment, the light illuminator 22 can be any known light illuminating device such as fluorescent lamps, energy-saving lamps, LED illuminating devices. As an example of this preferred embodiment, the light illuminator 22 can be an LED lamp with a direct input voltage of 12V. The second power-down activation switch 21 is electrically connected to the normally closed relay 51, the storage battery assembly 50 and the light illuminator 22. Referring to FIG. 5 of the drawings, the second power-down activation switch of this preferred embodiment can be a normally open relay. More specifically, the second power-down activation switch of this preferred embodiment is a normally open phase failure relay. An input terminal of the normally open relay 21 is in a parallel connection with the normally closed relay 51, and an output terminal of the normally open relay 21 is electrically connected to the storage battery 50 and the light illuminator 22. When disasters such as fire disasters and earthquakes or sudden emergencies take place, the domestic electricity supply which is electrically connected to the public power system may be out of service, the normally closed contacts of the normally closed relay 51 will be cut off because of a phase failure. At the same time, the normally open contacts of the normally open relay 21 will be switched on because of the phase failure, so that the storage battery assembly 50 is electrically connected to the light illuminator 22 so as to supply power to the light illuminator 22. Thus the light illuminator 22 can provide a light illumination to the people to be evacuated.

Referring to FIG. 1 of the drawings, each of the photovoltaic power generation arrangements 30 comprises at least one solar power panel 31 and a solar power controller 32 connected to the solar power panel 31. The solar power controller 32 is electrically connected to the solar power panel 31 and the storage battery 50. The solar power panel 31 can be a public known crystalline silicon power panel, an amorphous silicon power panel, or a poly compound solar cell. In this preferred embodiment, the solar power panel 31 can be a crystalline silicon power panel. The solar power controller 32 can be a pubic known solar power generation controller for controlling the operation of the whole photovoltaic power generation arrangement 30. The solar power controller 32 also can provide an overcharge protection and an overdischarge protection effect to the storage battery assembly 50. When in a place of large temperature difference, the solar power controller 32 can provide a temperature compensation function. The solar power panel 31 and the solar power controller 32 can be integrated to form a one-piece structure which is provided on top of the building. The solar power panel 31 can be provided with a solar ray tracing device so as to obtain the best incidence light rays.

Referring to FIG. 1 of the drawings, the wind electric power generation arrangement 40, which can be provided on top of the building, comprises a wind electric power generator 41 and a wind electric power charger 42 which is electrically connected to the wind electric power generator 41 and the storage battery assembly 50. In this preferred embodiment, the wind electric power generator 41 can be a public known horizontal axis wind electric power generator or a vertical axis wind electric power generator, preferably a double-fed induction generator. The wind electric power generator 41 comprises a wind turbine, a generator, a direction adjustor, a support frame, a speed limiting safety systems, and other known necessary components. In this preferred embodiment, the wind electric power charger 42 is an electricity charger with a rectifying circuit arranged for rectifying the alternating current from the wind electric power generator 41 into direct current so as to charge the storage battery assembly 50.

Referring to FIG. 1 of the drawings, the storage battery assembly 50 can be a Ni—H battery assembly, Ni—Cd battery assembly, Li battery assembly. Each of the storage battery assembly 50 may comprises of a plurality of batteries. The storage battery assembly 50 of this preferred embodiment is preferably a Li battery assembly for storing the electric power from the commercial power, one or more photovoltaic power generation arrangement 30 and one or more wind electric power generation arrangement 40, so as to supply power to the emergency lighting arrangement 20. The commercial power line, the photovoltaic power generation arrangement 30, the wind electric power generation arrangement 40, and the emergency lighting arrangement 20 is respectively electrically connected to the storage battery 50. More specifically, as shown in FIG. 1, the storage battery assembly 50 is electrically connected to the commercial power line via the normally closed relay 51 and the charger 52. When the domestic electricity supply is in a normal operation state, the storage battery assembly 50 is charged by the commercial power via the charger 52. Simultaneously, the photovoltaic power generation arrangement 30, and the wind electric power generation arrangement 40 also charge the storage battery assembly 50. Accordingly, the photovoltaic power generation arrangement 30 may charge the storage battery assembly 50 during daytime, the wind electric power generation arrangement 40 may charge the storage battery assembly 50 when there is a wind, so that a complementary power generation effect is provided. The storage battery assembly 50 can be provided with a charge protection switch, when the storage battery assembly 50 is fully charged, the charge protection switch will cut off so as to prevent the overcharge of the storage battery assembly 50. The output voltage of the storage battery assembly 50 can be DC 12V or 24V. In this preferred embodiment, the value can be DC 12V, so that a 12V direct current can be provided to the emergency lighting arrangement 20. The storage battery assembly 50, which can be integrated with the photovoltaic power generation arrangement 30 and the wind electric power generation arrangement 40 to form a one-piece structure, may be provided on top of the building to store electric power so as to supply power to the emergency lighting arrangement 20 in cases of disasters such as fire disasters and earthquakes or sudden emergencies.

Referring to FIG. 1 of the drawings, when the domestic electric power supply is cut off in case of disasters such as fire disasters and earthquakes or sudden emergencies, the normally open contacts of the normally open relays of the first power-down activation switch 11 and the second power-down activation switch 12 will be switched on because of the phase failure, the storage battery assembly 50 will be electrically connected to the emergency evacuation indication lighting 12 and the light illuminator 22 so as to supply power to the emergency evacuation indication lighting 12 and the light illuminator 22. Therefore, medley energy resources including commercial electric power and complementary energy resources such as solar power and wind power are used for providing the electricity power supply to the emergency evacuation indication lightings 12 and light illuminators 22 which are provided in corridors, staircases, evacuation passages, and safety exits of the building, thus energy saving and environment protection effect is achieved, and the emergency evacuation guide and emergency lighting are also provided.

Accordingly, the present invention actually provides an emergency lighting and evacuation guidance system which is powered by a commercial electricity supply and a complementary green power assembly 200. The commercial electricity supply can be the AV 220V electricity supply in China or other electricity supply such as the AV 110V electricity supply in America. When the emergency does not result in a breakdown of the commercial electricity supply, the emergency lighting and evacuation guidance system can be powered by the commercial electricity supply and people can be guided to evacuate and escape under the emergency lighting and evacuation guidance system. However, when the commercial electricity supply is cut off during the emergency, the power generated by the complementary power assembly is instantly activated to provide power supply to the emergency lighting and evacuation guidance system.

In other words, there is no need to provide an additional backup battery for providing power supply to the emergency lighting and evacuation guidance system. The complementary green power assembly 200 can be used to generate power so as to prepare a backup power supply which is ready for action during an emergency. More specifically, the emergency lighting and evacuation guidance system comprises an emergency lighting and evacuation guidance arrangement 100 which is electrically connected to the commercial electricity supply and also is electrically connected to the complementary green power assembly 200. When the commercial electricity supply is cut off during a disaster or an emergency, the power generated by the complementary green power assembly 200 is supplied to the emergency lighting and evacuation guidance arrangement 100 so as to guide and evacuate the people during a disaster or an emergency.

According, the supply of power generated by the complementary green power assembly 200 can be manually started by providing a manual switch. Preferably, the supply of power generated by the complementary green power assembly 200 can be automatically started immediately when the commercial electricity supply is cut off. In other words, when a disaster or an emergency takes place, time is precious for rescuing the people in the building. In other words, the emergency lighting and evacuation guidance arrangement should be activated as early as possible to save lives.

A storage battery assembly 50 is electrically connected to both of the commercial electricity supply and the green power assembly 200. Thus, the power generated by the green power assembly 200 can be stored in the storage battery assembly 50. Normally, the emergency lighting and evacuation guidance arrangement 100 can be powered by the storage battery assembly 50 which is electrically connected to the commercial electricity supply when the commercial electricity supply is not cut off. When the commercial electricity supply is cut off during a disaster or an emergency, the power which is generated by the green power assembly 200 and stored in the storage battery assembly 50 will be supplied to the emergency lighting and evacuation guidance arrangement 100 to guide the people to evacuate and escape during the disaster or the emergency.

Accordingly, the complementary green power assembly 200 according to this preferred embodiment of the present invention comprises a photovoltaic power generation arrangement 30 and a wind electric power generation arrangement 40, as mentioned above. Other green power resources also may be employed.

During daytime, the photovoltaic power generation arrangement 30 can be in an operation state to generate power which is stored in the storage battery assembly 50. The wind electric power generation arrangement 40 can operate in response to the wind around the building so that the power generated also can be stored in the storage battery assembly 50. The electricity supply can be automatically shifted to the complementary power assembly when the commercial electricity supply is cut off during an emergency or a disaster, so as to win time for people to evacuate and escape.

The emergency lighting and evacuation guidance arrangement 100 according to this preferred embodiment of the present invention can comprise an emergency evacuation guidance arrangement 10 and an emergency lighting arrangement 20, as mentioned above. In addition of the runner signs and text exit sings, the emergency evacuation guidance arrangement 10 may provide other evacuation information during the disaster or the emergency, for example, a desired evacuation route or a map may be displayed on a display 13 of the emergency evacuation guidance arrangement 10 to guide the people to escape by following the guidance. The emergency lighting arrangement 20 is arranged for providing an illumination when the disaster or the emergency takes place in night or providing an illumination in a dark zone in the building. The emergency evacuation guidance arrangement 10 may further comprise an emergency loud speaker 14, so that the emergency information can be vocally delivered to the people immediately when the emergency takes place.

More specifically, the emergency evacuation guidance arrangement 10 is electrically connected to the storage battery assembly 50 via the first power-down activation switch 11. The first power-down activation switch 11 is electrically connected to the normally closed relay 51 which can be cut off because of a phase failure during a disaster or an emergency, so that the first power-down activation switch 11 is then automatically switched on because of the phase failure so as to provide the power supply to the emergency evacuation guidance arrangement 10.

The emergency lighting arrangement 20 is electrically connected to the storage battery assembly 50 via the second power-down activation switch 12. The second power-down activation switch 12 is electrically connected to the normally closed relay 51 which can be cut off because of a phase failure during a disaster or an emergency, so that the second power-down activation switch 12 is then automatically switched on because of the phase failure so as to provide the power supply to the emergency lighting arrangement 20.

Therefore, the present invention provides a method of assembling an emergency lighting and evacuation guidance system which comprises the following steps.

(a) Electrically connect at least one emergency lighting and evacuation guidance arrangement 100 to a commercial electricity supply.

(b) Electrically connect at least one complementary green power assembly 200 to the emergency lighting and evacuation guidance arrangement 100.

(c) Selectively supply power to the emergency lighting and evacuation guidance arrangement 100 through the commercial electricity supply and the complementary green power assembly 200 to activate the emergency lighting and evacuation guidance arrangement 100 for guiding people to evacuate and escape during an emergency.

Accordingly, in the step (c), the commercial electricity supply is normally used to supply power to the emergency lighting and evacuation guidance arrangement 100 when the commercial electricity supply is not cut off. When the commercial electricity supply is cut off during the emergency (disaster), the power generated by the complementary green power assembly 200 is used to supply power to the emergency lighting and evacuation guidance arrangement 100.

The step (c) may further comprise a step (d) of automatically switching on a power supply from the complementary green power assembly 200 when the commercial electricity supply is cut off during the emergency. Accordingly the step (d) may further comprise a step of automatically switching off a normally closed relay which is coupled to the commercial electricity supply because of phase failure during the emergency, and simultaneously switch on at least one normally open relay which is coupled with the normally closed relay in such a manner the power generated by the complementary green power assembly is supplied to activate the emergency lighting and evacuation guidance arrangement 100.

The method may further comprise a step (e): electrically connect a storage battery assembly 50 to the commercial electricity supply and the complementary green power assembly 200, wherein the power generated by the green power assembly is stored in the storage battery assembly, wherein the emergency lighting and evacuation guidance arrangement 100 is powered by the storage assembly 50. Accordingly, when the emergency takes place, the power supply to the storage battery assembly 50 by the commercial electricity supply may be cut off. However, the power which is generated by the green power assembly and stored in the storage battery assembly can then be used to activate the emergency lighting and evacuation guidance arrangement 100.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An emergency lighting and evacuation guidance system, comprising:

an emergency lighting and evacuation guidance arrangement, which is electrically connected to a commercial electricity supply, comprising at least one emergency evacuation guidance arrangement which is provided in a building for providing an evacuation information during the emergency, said evacuation information is selected from a group consisting of a runner safety exit sign, a text safety exit sign, an evacuation map, an indication information of a location of the emergency, and the combinations thereof, and at least one emergency lighting arrangement, which is provided at a location selected from a group consisting of a corridor, a staircase, an evacuation passage, a safety exit of the building, and the combinations thereof, for providing a lighting during the emergency;

a complementary green power assembly which is electrically connected to the emergency lighting and evacuation guidance arrangement, wherein when the commercial electric supply is cut off during an emergency, the power generated by said complementary green power assembly is supplied to said emergency lighting and evacuation guidance arrangement, whereby said emergency lighting and evacuation guidance arrangement guides people to evacuate and escape during the emergency, wherein said complementary green power assembly comprises at least one photovoltaic power generation arrangement and at least one wind electric power generation arrangement;

a storage battery assembly, wherein said complementary green power assembly and the commercial electricity supply are both electrically connected to said storage battery assembly, wherein said emergency lighting and evacuation guidance arrangement is powered by said storage battery assembly, wherein said photovoltaic power generation arrangement and said wind electric power generation arrangement are electrically connected to said storage battery assembly, so that the power generated by said photovoltaic power generation arrangement and said wind electric power generation arrangement is stored in said storage battery assembly; and a normally closed relay which electrically connecting said storage battery assembly with the commercial electricity supply, wherein said emergency evacuation guidance arrangement further comprises a first power-down activation switch and at least one emergency evacuation indication lighting, wherein said first power-down activation switch is electrically connected to said normally closed relay, said storage battery assembly, and said emergency evacuation indication lighting, wherein when the emergency takes place and the commercial electricity supply is cut off, said normally closed relay is switched off, and said first power-down activation switch is automatically switched on to electrically connect said storage battery assembly and said emergency evacuation indication lighting in such a manner that said storage battery assembly provides an electricity supply to said emergency evacuation indication lighting.

2. The emergency lighting and evacuation guidance system, as recited in claim 1, wherein said emergency evacuation indication lighting is an LED lamp which is provided for displaying a safety exit sign and a text sign.

3. An emergency lighting and evacuation guidance system, comprising:

an emergency lighting and evacuation guidance arrangement, which is electrically connected to a commercial electricity supply, comprising at least one emergency evacuation guidance arrangement which is provided in a building for providing an evacuation information during the emergency, said evacuation information is selected from a group consisting of a runner safety exit sign, a text safety exit sign, an evacuation map, an indication information of a location of the emergency, and the combinations thereof, and at least one emergency lighting arrangement, which is provided at a location selected from a group consisting of a corridor, a staircase, an evacuation passage, a safety exit of the building, and the combinations thereof, for providing a lighting during the emergency;

a complementary green power assembly which is electrically connected to the emergency lighting and evacuation guidance arrangement, wherein when the commercial electric supply is cut off during an emergency, the power generated by said complementary green power assembly is supplied to said emergency lighting and evacuation guidance arrangement, whereby said emergency lighting and evacuation guidance arrangement guides people to evacuate and escape during the emergency, wherein said complementary green power assembly comprises at least one photovoltaic power generation arrangement and at least one wind electric power generation arrangement;

a storage battery assembly, wherein said complementary green power assembly and the commercial electricity supply are both electrically connected to said storage battery assembly, wherein said emergency lighting and evacuation guidance arrangement is powered by said storage battery assembly, wherein said photovoltaic power generation arrangement and said wind electric power generation arrangement are electrically connected to said storage battery assembly, so that the power generated by said photovoltaic power generation arrangement and said wind electric power generation arrangement is stored in said storage battery assembly; and a normally closed relay which electrically connecting said storage battery assembly with the commercial electricity supply, wherein said emergency lighting arrangement comprises a second power-down activation switch and at least one light illuminator, wherein said second power-down activation switch is electrically connected to said normally closed relay, storage battery assembly, and said light illuminator, herein when the emergency takes place and the commercial electricity supply is cut off, said normally closed relay is switched off, and said second power-down activation switch is automatically switched on to electrically connect said storage battery assembly and said light illuminator in such a manner that said storage battery assembly provides an electricity supply to said light illuminator.

4. The emergency lighting and evacuation guidance system, as recited in claim 3, wherein said light illuminator is an LED lamp.

* * * * *